US010844719B2

(12) United States Patent
Takeuchi et al.

(10) Patent No.: US 10,844,719 B2
(45) Date of Patent: Nov. 24, 2020

(54) SCROLL FLUID MACHINE INCLUDING A PAIR OF FIXED SCROLLS AND AN ORBITING SCROLL

(71) Applicant: MITSUBISHI HEAVY INDUSTRIES THERMAL SYSTEMS, LTD., Tokyo (JP)

(72) Inventors: Makoto Takeuchi, Tokyo (JP); Genta Yoshikawa, Tokyo (JP); Hajime Sato, Tokyo (JP); Takuma Yamashita, Tokyo (JP); Takayuki Hagita, Kiyosu (JP); Takayuki Kuwahara, Kiyosu (JP); Katsuhiro Fujita, Kiyosu (JP); Kazuhide Watanabe, Kiyosu (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 98 days.

(21) Appl. No.: 15/544,186

(22) PCT Filed: Jan. 22, 2016

(86) PCT No.: PCT/JP2016/051911
§ 371 (c)(1),
(2) Date: Jul. 17, 2017

(87) PCT Pub. No.: WO2016/121658
PCT Pub. Date: Aug. 4, 2016

(65) Prior Publication Data

US 2017/0370219 A1 Dec. 28, 2017

(30) Foreign Application Priority Data

Jan. 28, 2015 (JP) ..... 2015-014465

(51) Int. Cl.
*F03C 2/00* (2006.01)
*F03C 4/00* (2006.01)
(Continued)

(52) U.S. Cl.
CPC ..... *F01C 1/0215* (2013.01); *F01C 1/0276* (2013.01); *F01C 1/0284* (2013.01);
(Continued)

(58) Field of Classification Search
CPC ..... F04C 18/0215; F04C 18/0246; F04C 18/0269; F04C 18/0276; F04C 18/0284;
(Continued)

(56) References Cited

U.S. PATENT DOCUMENTS 6,050,792 A * 4/2000 Shaffer ..... F04C 18/0246 418/55.2
2002/0114720 A1 8/2002 Itoh et al.
(Continued)

FOREIGN PATENT DOCUMENTS

JP 60-17956 B2 5/1985
JP 8-326668 A 12/1996
(Continued)

OTHER PUBLICATIONS

International Preliminary Report on Patentability (Form PCT/IPEA/409) for International Application No. PCT/JP2016/051911, dated Apr. 24, 2017, including an English translation.
(Continued)

*Primary Examiner* — Theresa Trieu
(74) *Attorney, Agent, or Firm* — Birch, Stewart, Kolasch & Birch, LLP

(57) ABSTRACT

One of a pair of a fixed scroll and an orbiting scroll is the scroll including a step portion provided only at a predetermined position along a spiral direction on a blade bottom surface of a spiral wrap, and the other one of the scrolls is
(Continued)

the scroll including a step portion provided only at a predetermined position along a spiral direction on a blade tip surface of a spiral wrap. A blade bottom surface of an end plate of the fixed scroll is set as a reference surface for setting a chip gap between both the scrolls. When a wrap height of the spiral wrap of the orbiting scroll is represented by (L) (Lo, Li) and a wrap height of the spiral wrap of the fixed scroll is represented by (lo, li), L (Lo, Li)>1 (lo, li) is satisfied.

2 Claims, 1 Drawing Sheet

(51) Int. Cl.
*F04C 18/00* (2006.01)
*F01C 1/02* (2006.01)
*F04C 18/02* (2006.01)
*F01C 19/08* (2006.01)

(52) U.S. Cl.
CPC ..... *F04C 18/0215* (2013.01); *F01C 19/08* (2013.01); *F04C 2230/602* (2013.01)

(58) Field of Classification Search
CPC ..... F04C 27/005; F04C 23/008; F04C 2230/602; F01C 1/0215; F01C 1/0284; F01C 1/0276; F01C 19/08
USPC ..... 418/55.1–55.6, 57, 142
See application file for complete search history.

(56) References Cited

U.S. PATENT DOCUMENTS

| | | | | |
|---|---|---|---|---|
| 2004/0101428 | A1 | 5/2004 | Shibamoto et al. | |
| 2006/0099096 | A1 | 5/2006 | Shaffer et al. | |
| 2006/0177332 | A1* | 8/2006 | Kim | F04C 18/0246 418/55.2 |
| 2010/0021328 | A1 | 1/2010 | Yamazaki et al. | |

FOREIGN PATENT DOCUMENTS

| | | | |
|---|---|---|---|
| JP | 9-32744 | A | 2/1997 |
| JP | 2002-5052 | A | 1/2002 |
| JP | 2002-70769 | A | 3/2002 |
| JP | 2002-206491 | A | 7/2002 |
| JP | 2003-269346 | A | 9/2003 |
| JP | 2008-133806 | A | 6/2008 |
| JP | 4681322 | B2 | 5/2011 |
| JP | 2011-174453 | A | 9/2011 |

OTHER PUBLICATIONS

International Search Report and Written Opinion of the International Searching Authority (Forms PCT/ISA/210 and PCT/ISA/237) for International Application No. PCT/JP2016/051911, dated Apr. 26, 2016, including an English translation of the International Search Report.

* cited by examiner

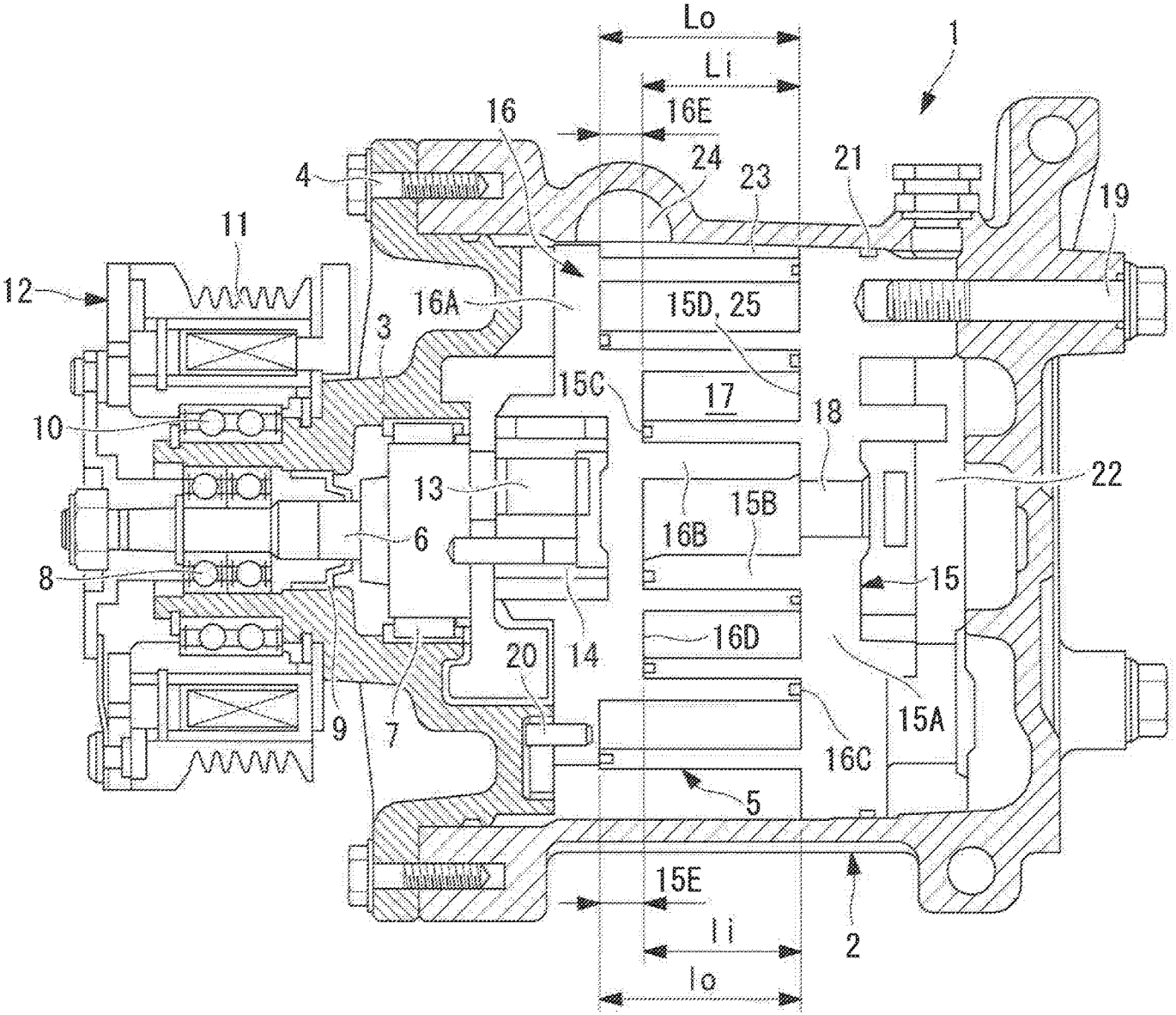
1
2
3
4
5
6
7
8
9
10
11
12
13
14
15
15A
15B
15C
15D, 25
15E
16
16A
16B
16C
16D
16E
17
18
19
20
21
22
23
24
Lo
Li
li
lo

SCROLL FLUID MACHINE INCLUDING A PAIR OF FIXED SCROLLS AND AN ORBITING SCROLL

TECHNICAL FIELD

The present invention relates to a scroll fluid machine that can be applied to a compressor, a pump, an expander, and the like.

BACKGROUND ART

A scroll fluid machine includes a pair of a fixed scroll and an orbiting scroll in a state where spiral wraps are erected on an end plate. The scroll fluid machine has a structure in which the spiral wraps of the pair of the fixed scroll and the orbiting scroll are opposed to each other and are caused to engage with each other by shifting the phase thereof by 180 degrees, and a working chamber sealed between the scrolls is formed to supply or discharge a fluid. In the scroll fluid machine, for example, a scroll compressor generally has a two-dimensional compression structure in which the wrap height of the spiral wrap of each of the fixed scroll and the orbiting scroll is set to be uniform on the entire circumference in a spiral direction and a compression chamber is moved from the outer peripheral side to the inner peripheral side, while the volume thereof is reduced, to thereby compress a fluid sucked into the compression chamber in the circumferential direction of the spiral wrap.

On the other hand, in order to increase the efficiency of the scroll compressor and reduce the size and weight thereof, step portions are provided at predetermined positions along the spiral direction on a blade tip surface and a blade bottom surface of the spiral wrap of each of the fixed scroll and the orbiting scroll. At the step portions, the wrap height on the outer peripheral side of the spiral wrap is set to be higher than the wrap height on the inner peripheral side and the height of the compression chamber in the axis line direction on the outer peripheral side of the spiral wrap is set to be higher than the height on the inner peripheral side, thereby providing a scroll compressor of a three-dimensional compression type having a structure for compressing a fluid in both the peripheral direction and the height direction of the spiral wrap.

As such a scroll compressor of a three-dimensional compression type, for example, as disclosed in PTL 1 and PTL 2, the following structures are known. That is, a structure in which step portions are provided at predetermined positions along a spiral direction on a blade tip surface and a blade bottom surface of scroll spiral wraps of a fixed scroll and an orbiting scroll, and a structure in which, as disclosed in PTL 3, one of a fixed scroll and an orbiting scroll is a scroll including a step portion provided only at a predetermined position along a spiral direction on a blade bottom surface of the spiral wrap, and the other one of the fixed scroll and the orbiting scroll is a scroll including a step portion provided only at a predetermined position along the spiral direction on a blade tip surface of the spiral wrap.

CITATION LIST

Patent Literature

{PTL 1} Japanese Unexamined Patent Application, Publication No. 2002-5052

{PTL 2} Japanese Unexamined Patent Application, Publication No. 2008-133806

{PTL 3} Japanese Examined Patent Application, Publication No. Sho 60-17956 (see FIG. 8)

SUMMARY OF INVENTION

Technical Problem

In the scroll compressor having the three-dimensional compression structure, as disclosed in PTL 1 and PTL 2, in the structure in which step portions are provided on the blade tip surface and the blade bottom surface of the spiral wraps of both the fixed scroll and the orbiting scroll, the blade tip surface and the blade bottom surface are in contact at four positions: (1) an orbiting outer peripheral blade tip/a fixed outer peripheral blade bottom; (2) a fixed outer peripheral blade tip/an orbiting outer peripheral blade bottom; (3) an orbiting inner peripheral blade tip/a fixed inner peripheral blade bottom; and (4) a fixed inner peripheral blade tip/an orbiting inner peripheral blade bottom. Accordingly, the area of a reference surface for determining the parallelism between the scrolls is reduced, so that the parallelism of a chip gap between the blade tips of the spiral gaps is liable to vary and leakage of a fluid from the blade tips of the spiral wraps increases.

Specifically, in the structure in which step portions are provided on the blade tip surface and the blade bottom surface of the spiral wraps of both the scrolls, as disclosed in PTL 1, a thermal expansion or the like is taken into consideration and, for example, the chip gap on the inner peripheral side of the step portions is set to be larger than the chip gap on the outer peripheral side of the step portions. However, since the reference surface for determining the chip gap at the blade tip cannot be formed over the entire surface of the end plate of the scroll, the area of the reference surface is reduced, which causes a problem that, for example, the parallelism of the chip gap is liable to vary.

Further, since the area of the reference surface is reduced, it is necessary to prevent the blade tip surface and the blade bottom surface of each spiral wrap from being brought into contact with each other in a portion other than the reference surface. This causes a problem such as an increase in average chip gap. For example, in the structure disclosed in PTL 2, when the blade bottom surface on the inner peripheral side of the step portion of the fixed scroll illustrated in FIG. 2 is set as a reference surface, the blade tip surface and the blade bottom surface are not in contact with each other at seven positions other than the reference surface.

On the other hand, PTL 3 discloses a scroll compressor of a three-dimensional compression type in which one of the fixed scroll and the orbiting scroll is a scroll including a step portion provided only at the predetermined position along the spiral direction on the blade bottom surface of the spiral wrap, and the other one of the fixed scroll and the orbiting scroll is a scroll including a step portion provided only at the predetermined position along the spiral direction on the blade tip surface of the spiral wrap. PTL 3 neither discloses nor suggests the position where the reference surface is formed and how to set the chip gap in the scroll compressor having the three-dimensional compression structure.

The present invention has been made in view of the above-mentioned circumstances, and an object of the present invention is to provide a scroll fluid machine having a three-dimensional compression structure capable of solving the above-mentioned problem inherent in the three-dimensional scroll fluid machine including step portions on the blade tip surface and the blade bottom surface of the spiral wraps of both the scrolls.

Solution to Problem

To solve the above-mentioned problem, the scroll fluid machine according to the present invention employs the following solutions.

That is, the scroll fluid machine according to the present invention includes a pair of a fixed scroll and an orbiting scroll having a structure in which spiral wraps are erected on end plates, respectively, and the spiral wraps engage with each other. One of the fixed scroll and the orbiting scroll is a scroll including a step portion provided only at a predetermined position along a spiral direction on a blade bottom surface of the spiral wrap, and the other one of the fixed scroll and the orbiting scroll is a scroll including a step portion provided only at a predetermined position along a spiral direction on a blade tip surface of the spiral wrap. A blade bottom surface of the end plate of the scroll which does not include the step portion on the blade bottom surface is set as a reference surface for setting a chip gap between the scrolls. When a wrap height of the spiral wrap of the scroll including the step portion on the blade bottom surface is represented by L and a wrap height of the spiral wrap of the scroll which does not include the step portion on the blade bottom surface is represented by 1, L>1 is satisfied.

According to the present invention, the blade bottom surface of the end plate of the scroll which does not include a step portion on the blade bottom surface is set as a reference surface, and the blade tip surface of the spiral wrap of the scroll in which the wrap height of the spiral wrap is represented by L and which does not include a step portion on the blade tip surface is brought into contact with the reference surface. With this structure, the chip gap can be set between both the scrolls, and thus the reference surface can be increased (widened) when the chip gap is set, as compared with a structure in which step portions are provided on the blade tip surface and the blade bottom surface of the spiral wraps of both the scrolls. Accordingly, the parallelism of the chip gap is increased and a variation in the chip gap is reduced, thereby reducing leakage of a fluid from the chip gap and achieving a further improvement in the efficiency and performance of the scroll fluid machine. Further, the reference surface is increased to reduce the number of locations where the blade tip surface and the blade bottom surface need to be prevented from being brought into contact with each other in a portion other than the reference surface, and the size of the average chip gap is reduced, thereby making it possible to improve the volumetric efficiency and the overall adiabatic efficiency.

Further, according to the scroll fluid machine of the present invention, in the scroll fluid machine, the entire blade bottom surface of the end plate of the scroll which does not include the step portion on the blade bottom surface is set as a reference surface for setting a chip gap between the blade bottom surface of the end plate of the scroll and the blade tip surface of the spiral wrap of the counterpart scroll to engage with the scroll.

According to the present invention, when the entire length of the diameter of the end plate of the scroll which does not include the step portion on the blade bottom surface of the spiral wrap is set as a reference surface, and is brought into contact with the blade tip surface of the scroll which does not include the step portion on the blade tip surface of the spiral wrap, thereby making it possible to set the chip gap. With this structure, the reference surface for setting the chip gap is maximized and the average chip gap is minimized, thereby achieving a further improvement in the efficiency and performance of the scroll fluid machine.

Further, according to the scroll fluid machine of the present invention, in any one of the scroll fluid machines described above, the fixed scroll is a scroll which does not include the step portion on the blade bottom surface.

According to the present invention, the scroll which does not include the step portion on the blade bottom surface is set as the fixed scroll that is fixed and installed on the side where a fixing member is located. The blade bottom surface of the end plate is set as a reference surface. The blade tip surface of the spiral wrap of the orbiting scroll in which the wrap height is represented by L and which does not include the step portion on the blade tip surface is brought into contact with the reference surface, thereby making it possible to set the chip gap between both the scrolls. Accordingly, the chip gap can be stably set in a state where the fixed scroll is fixed and installed, thereby reducing a variation at the time of setting the chip gap and reducing the average chip gap.

Advantageous Effects of Invention

According to the present invention, the blade bottom surface of the end plate of the scroll which does not include the step portion on the blade bottom surface of the pair of the fixed scroll and the orbiting scroll is set as a reference surface, and the blade tip surface of the spiral wrap of the scroll in which the wrap height of the spiral wrap is represented by L and which does not include the step portion on the blade tip surface is brought into contact with the reference surface. With this structure, the chip gap can be set between both the scrolls, and thus the reference surface can be increased (widened) when the chip gap is set, as compared with a structure in which step portions are provided on the blade tip surface and the blade bottom surface of the spiral wraps of both the scrolls. Accordingly, the parallelism of the chip gap is increased and a variation in the chip gap is reduced, thereby reducing leakage of a fluid from the chip gap and achieving a further improvement in the efficiency and performance of the scroll fluid machine. Further, the reference surface is increased to reduce the number of locations where the blade tip surface and the blade bottom surface need to be prevented from being brought into contact with each other in a portion other than the reference surface, and the size of the average chip gap is reduced, thereby making it possible to improve the volumetric efficiency and the overall adiabatic efficiency.

BRIEF DESCRIPTION OF DRAWING

FIG. 1 is a sectional view illustrating a scroll fluid machine according to one embodiment of the present invention.

DESCRIPTION OF EMBODIMENTS

An embodiment of the present invention will be described below with reference to FIG. 1.

FIG. 1 is a sectional view illustrating a scroll fluid machine according to an embodiment of the present invention.

As an example of the scroll fluid machine, an example in which an open-type scroll compressor of a type that is driven by power externally supplied is applied will be described.

An open-type scroll compressor (scroll fluid machine) 1 includes a housing 2 that constitutes an outline of the compressor as illustrated in FIG. 1. The housing 2 has an opening at a front end thereof and has a cylindrical shape sealed at a rear end thereof. A front housing 3 is fastened and fixed to the opening at the front end side with a bolt 4, thereby forming an enclosed space in the housing and incorporating a scroll compression mechanism 5 and a drive shaft 6 into the enclosed space.

The drive shaft 6 is rotatably supported by the front housing 3 through a main bearing 7 and a sub bearing 8. A pulley 11 that is rotatably installed the outer peripheral portion of the front housing 3 through a bearing 10 is coupled to a front end, which projects to the outside from the front housing 3 through a mechanical seal 9, through an electromagnetic clutch 12, thereby enabling transmission of power from the outside. At a rear end of the drive shaft 6, a crank pin 13, which is decentered by a predetermined dimension, is integrally formed and is coupled to an orbiting scroll 16 of the scroll compression mechanism 5, which is described later, through a well-known driven crank mechanism 14 including a drive bushing and a drive bearing which allow the orbiting radius thereof to be variable.

In the scroll compression mechanism 5, a pair of a fixed scroll 15 and an orbiting scroll 16 engage with each other by shifting a phase by 108 degrees, thereby forming a pair of compression chambers 17 between both the scrolls 15 and 16. The compression chambers 17 are moved to a central position from an outer peripheral position while the volume thereof is gradually reduced, thereby compressing a fluid (refrigerant gas). The fixed scroll 15 includes a discharge port 18 that discharges a compressed gas at a central part thereof, and is fixed and installed at the bottom wall surface of the housing 2 through a bolt 19. The orbiting scroll 16 is coupled to the crank pin 13 of the drive shaft 6 through the driven crank mechanism 14, and is supported by a thrust bearing surface of the front housing 3 through a well-known rotation inhibiting mechanism 20 in such a manner that the orbiting scroll can be driven to revolve.

An O-ring 21 is provided on the outer periphery of an end plate 15A of the fixed scroll 15. The O-ring 21 is in close contact with the inner peripheral surface of the housing 2, and the inside space of the housing 2 is partitioned into a discharge chamber 22 and an intake chamber 23. The discharge chamber 22 has the discharge port 18 through which a compressed gas supplied from the compression chamber 17 is discharged, and the compressed gas is discharged to a refrigeration cycle side. In the intake chamber 23, an intake port 24 which is provided on the housing 2 is opened. A low-pressure gas that is circulated in a refrigeration cycle is sucked in and a refrigerant gas is sucked in the compression chamber 17 through the intake chamber 23.

The pair of the fixed scroll 15 and the orbiting scroll 16 have a structure in which spiral wraps 15B and 16B are erected on end plates 15A and 16A, respectively. In this embodiment, one of the fixed scroll 15 and the orbiting scroll 16, i.e., the fixed scroll 15 in this case, is a scroll that includes a step portion 15E which is provided only at a predetermined position along the spiral direction on a blade tip surface 15C of a spiral wrap 15B. The other scroll, i.e., the orbiting scroll 16, is a scroll that includes a step portion 16E which is provided at a predetermined position (a position corresponding to the step portion 15E provided on the blade tip surface 15C of the spiral wrap 15B in the fixed scroll 15) along the spiral direction on a blade bottom surface 16D of a spiral wrap 16B.

On a blade bottom surface 15D of the fixed scroll 15 which does not include a step portion on the blade bottom surface 15D, the entire surface of the end plate 15A is a flat surface. Between the blade bottom surface 15D and a blade tip surface 16C of the orbiting scroll 16 which does not include a step portion on the blade tip surface 16C, a reference surface 25 for setting a chip gap between both the scrolls 15 and 16 is formed. With this structure, the entire surface (entire diameter) of the end plate 15A of the fixed scroll 15 can be set as the reference surface 25.

Wrap heights Lo and Li of the spiral wrap 16B of the orbiting scroll 16 which does not include a step portion on the blade tip surface 16C are equal to or greater than wrap heights lo and li of the spiral wrap 15B of the fixed scroll 15 which includes the step portion 15E on the blade tip surface 15C (Lo, Li≥lo, li), and are desirably set to be greater than the wrap heights lo and li of the spiral wrap 15B by a predetermined dimension (for example, several tens of microns) (Lo, Li>lo, li). Thus, at the setting of the chip gap between both the scrolls 15 and 16, the blade tip surface 16C of the spiral wrap 16B in the orbiting scroll 16 can reliably be brought into contact with the reference surface, thereby preventing only the blade tip surface 15C in the fixed scroll 15 from being brought into contact with the blade bottom surface 16D in the orbiting scroll 16.

With the structure described above, according to this embodiment, the following operation and effects are obtained.

When the scroll compressor 1 described above is energized by the electromagnetic clutch 12, power is input to the drive shaft 6 from a drive source through a pulley 11 and the electromagnetic clutch 12 and the drive shaft 6 is rotationally driven, thereby allowing the orbiting scroll 16, which is coupled to the crank pin 13 of the drive shaft 6 through the driven crank mechanism 14 including the drive bushing, from being driven so as to revolve around the fixed scroll 15.

With this structure, a low-pressure refrigerant gas sucked into the intake chamber 23 from the refrigeration cycle side through the intake port 24 is sucked into the pair of compression chambers 17. This refrigerant gas is compressed when the volume of the compression chambers 17 is reduced along with an orbiting movement toward the central position, and the refrigerant gas is discharged into the discharge chamber 22 through the discharge port 18 which is provided at the central portion of the fixed scroll 15 and is further discharged to the refrigeration cycle.

During this compression process, the spiral wrap 15B of the fixed scroll 15 and the spiral wrap 16B of the orbiting scroll 16 are sealed when the wrap surfaces are brought into contact with each other by the action of the driven crank mechanism 14. On the other hand, the chip gap between the blade tip surfaces 15C and 16C of the spiral wraps 15B and 16B and the blade bottom surfaces 15D and 16D thereof is sealed via a chip seal (not illustrate) which is interposed between the blade tip surfaces 15C and 16C, thereby reducing leakage of gas from the compression chamber 17 as much as possible. However, the leakage of gas from the chip gap depends on whether or not the chip gap can be set within an allowable range without causing any variation during assembling.

In this embodiment, the so-called stepped scroll compressor 1 capable of three-dimensional compression is used. One of the pair of the fixed scroll 15 and the orbiting scroll 16, i.e., the orbiting scroll 16, is a scroll including the step portion 16E which is provided only at the predetermined position along the spiral direction on the blade bottom surface 16D of the spiral wrap 16B, and the other one of the scrolls, i.e., the fixed scroll 15, is a scroll including the step portion 15E which is provided only at the predetermined position along the spiral direction on the blade tip surface 15C of the spiral wrap 15B. The blade bottom surface 15D of the end plate 15A of the fixed scroll 15 which does not include a step portion on the blade bottom surface 15D is set as the reference surface 25 for setting the chip gap between both the scrolls 15 and 16. The relationship between the wrap heights Lo and Li of the spiral wrap 16B of the orbiting scroll 16 which includes the step portion 16E on the blade bottom surface 16D and the wrap heights lo and li of the spiral wrap 15B of the fixed scroll 15 which does not include a step portion on the blade bottom surface 15D satisfy "Lo, LI≥lo, Li", and preferably, "Lo, LI>lo, Li".

Accordingly, the blade bottom surface 15D of the end plate 15A of the fixed scroll 15 which does not include a step portion on the blade bottom surface 15D is set as the reference surface 25. The blade tip surface 16C of the spiral wrap 16B of the orbiting scroll 16 which does not include the step portion on the blade tip surface 16C and in which the wrap height Lo and Li of the spiral wrap 16B with respect to the reference surface 25 are set to be higher than the wrap heights lo and li of the spiral wrap 15B of the fixed scroll 15 is reliably brought into contact with the reference surface, thereby making it possible to set the chip gap between both the scrolls 15 and 16. Therefore, the reference surface 25 can be increased (widened) when the chip gap is set, as compared with a structure in which step portions are provided on the blade tip surfaces 15C and 16C and the blade bottom surfaces 15D and 16D of the spiral wraps 15B and 16B of both the scrolls 15 and 16.

With this structure, the parallelism of the chip gap is increased and a variation in the chip gap is reduced, thereby reducing leakage of a fluid from the chip gap and achieving a further improvement in the efficiency and performance of the scroll compressor (scroll fluid machine) 1. Further, the reference surface 25 is increased to reduce the number of locations where the blade tip surfaces 15C and 16C and the blade bottom surfaces 15D and 16D need to be prevented from being brought into contact in a portion other than the reference surface 25 (in this embodiment, five locations on the blade tip surface 15C of the fixed scroll 15 and the blade bottom surface 16D of the orbiting scroll 16), and the size of the average chip gap is reduced, thereby making it possible to improve the volumetric efficiency and the overall adiabatic efficiency.

Further, in this embodiment, the entire blade bottom surface 15D of the end plate 15A of the fixed scroll 15 which does not include the step portion on the blade bottom surface 15D is set as the reference surface 25 for setting the chip gap between the blade bottom surface of the end plate of the scroll and the blade tip surface 16C of the spiral wrap 16B of the counterpart orbiting scroll 16 that engage with the fixed scroll 15. Accordingly, the entire surface (entire diameter) of the end plate 15A of the fixed scroll 15 which does not include the step portion on the blade bottom surface 15D of the spiral wrap 15B is set as the reference surface 25, and is brought into contact with the blade tip surface 16C of the orbiting scroll 16 which does not include the step portion on the blade tip surface 16C of the spiral wrap 16B, thereby making it possible to set the chip gap. Therefore, the reference surface 25 for setting the chip gap is maximized and the average chip gap is minimized, thereby achieving a further improvement in the efficiency and performance of the scroll fluid machine.

Further, in this embodiment, since the fixed scroll 15 is the scroll which does not include the step portion on the blade bottom surface 15D, the fixed scroll 15 which is fixed and installed on the side where the fixing member is located is the scroll which does not include the step portion on the blade bottom surface 15D, and the blade bottom surface 15D of the end plate 15A thereof is set as the reference surface 25 and is brought into contact with the blade tip surface 16C of the spiral wrap 16B of the orbiting scroll 16 in which the wrap height is represented by Lo and Li and which does not include the step portion on the blade tip surface 16C, thereby making it possible to set the chip gap between both the scrolls 15 and 16. Accordingly, the chip gap can be stably set in the state where the fixed scroll 15 is fixed and installed, thereby reducing a variation when the chip gap is set and further reducing the average chip gap.

Further, when the fixed scroll 15 is the scroll which does not include the step portion on the blade bottom surface 15D, the driven crank mechanism 14 including the drive bushing and the drive bearing can be installed in the step portion 16E on the end plate 16A in the orbiting scroll 16 which includes the step portion 16E on the blade bottom surface 16D. Therefore, the length of the scroll compressor 1 in the axial direction thereof can be reduced by the amount corresponding to the step portion, and the scroll compressor 1 can be downsized.

Further, in the scroll compressor 1 (for example, see the Publication of Japanese Patent No. 4681322) having a structure in which an oil which is contained in the low-pressure refrigerant gas sucked in the compression chamber 17 and which is separated in the compression chamber 17 is returned to the intake chamber 23, and an oil return passage provided for lubrication of a sliding portion, such as a bearing, which is installed in the intake chamber is provided at the end plate 16A of the orbiting scroll 16, the step portion 16E is provided on the end plate 16A of the orbiting scroll 16 to allow the oil accumulated on the blade bottom surface 16D of the end plate 16A of the orbiting scroll 16 within the compression chamber 17 at the outer peripheral side of the step portion 16E to be immediately returned to the intake chamber 23 through the oil return passage, thereby easily implementing an oil separator function of a so-called direct return system, which can be provided for lubrication of a sliding portion such as a bearing.

Note that the present invention is not limited to the invention according to the embodiment described above, and can be modified as appropriate without departing from the gist of the invention. For example, while the embodiment described above illustrates an example in which the present invention is applied to a scroll compressor, the present invention can also be applied to a scroll expander and a scroll pump. While the embodiment described above illustrates an example in which the present invention is applied to an open-type scroll compressor, the present invention can also be applied to a scroll compressor incorporating a compression mechanism and a motor.

While the embodiment illustrates an example in which the fixed scroll 15 is a scroll including the step portion 15E which is provided only on the blade tip surface 15C, and the orbiting scroll 16 is a scroll including the step portion 16E which is provided only on the blade bottom surface 16D, the fixed scroll 15 may be a scroll including the step portion only on the blade bottom surface 15D and the orbiting scroll 16 may be a scroll including the step portion only on the blade tip surface 16C. The position and height of each of the step portions 15E and 16E in the spiral direction, or the heights Lo and Li of the spiral wrap 15B and the heights lo and li of the spiral wrap 16B may be set as appropriate.

REFERENCE SIGNS LIST

1 Scroll compressor (scroll fluid machine)
15 Fixed scroll
16 Orbiting scroll
15A, 16A End plate
15B, 16B Spiral wrap
15C, 16C Blade tip surface
15D, 16D Blade bottom surface
15E, 16E Step portion
25 Reference surface
Lo, Li Wrap height of orbiting-scroll-side spiral wrap
lo, Li Wrap height of fixed-scroll-side spiral wrap

The invention claimed is:

1. A scroll fluid machine comprising:

a pair of a fixed scroll and an orbiting scroll having a structure in which spiral wraps are erected on end plates, respectively, and the spiral wraps engage with each other, wherein one of the fixed scroll and the orbiting scroll is a scroll including a step portion provided only at a predetermined position along a spiral direction on a blade bottom surface of the spiral wrap, and the other one of the fixed scroll and the orbiting scroll is a scroll including a step portion provided only at a predetermined position along a spiral direction on a blade tip surface of the spiral wrap, an entire blade bottom surface of the end plate of the scroll which does not include the step portion on the blade bottom surface is set as a reference surface for setting a chip gap between the blade bottom surface of the end plate of the scroll and the blade tip surface of the spiral wrap of a counterpart scroll to engage with the scroll, a wrap height of the spiral wrap of the scroll including the step portion on the blade bottom surface is made to be equal to a distance from the reference surface to the blade bottom surface on which the step portion is formed, and when the wrap height of the spiral wrap of the scroll including the step portion on the blade bottom surface is represented by L and a wrap height of the spiral wrap of the scroll which does not include the step portion on the blade bottom surface is represented by 1, L>1 is satisfied, so that the blade tip surface of the scroll including the step portion on the blade bottom surface is brought into contact with the reference surface, and the blade tip surface of the scroll which does not include the step portion on the blade bottom surface is not brought into contact with the blade bottom surface of the scroll including the step portion on the blade bottom surface.

2. The scroll fluid machine according to claim 1, wherein the fixed scroll is the scroll which does not include the step portion on the blade bottom surface.

* * * * *